US006176841B1

(12) United States Patent
Tso

(10) Patent No.: US 6,176,841 B1
(45) Date of Patent: Jan. 23, 2001

(54) FACIAL MASSAGER

(76) Inventor: Wang Kuo Tso, No. 11, Lane 72, Tien Hsiang St., Hsinchuang City, Taipei Hsien (TW)

( * ) Notice: Under 35 U.S.C. 154(b), the term of this patent shall be extended for 0 days.

(21) Appl. No.: 09/387,035

(22) Filed: Aug. 31, 1999

(51) Int. Cl.[7] ..... A61H 19/00
(52) U.S. Cl. ..... 601/137; 601/129; 601/131
(58) Field of Search ..... 601/84–90, 129, 601/131, 137

(56) References Cited

U.S. PATENT DOCUMENTS 1,635,744 * 7/1927 Duncan .
1,657,974 * 1/1928 Scoggin .
1,748,762 * 2/1930 Gilbert .

FOREIGN PATENT DOCUMENTS 3-182251 * 8/1991 (JP) .
9-271500 * 10/1997 (JP) .

* cited by examiner

*Primary Examiner*—Michael A. Brown
*Assistant Examiner*—Lalita Hamilton
(74) *Attorney, Agent, or Firm*—Curtis L. Harrington

(57) ABSTRACT

A facial massager includes a hollow cylindrical roller having an outer surface, an inner surface opposing the outer surface and defining a through hole, and a plurality of openings extending from the outer surface of the hollow cylindrical roller to the inner surface. The through hole allows an inner roller to be coaxially sleeved therein. The diameter of the inner roller is smaller than that of the through hole such that the inner roller is able to axially rotate inside the through hole. The inner roller is coupled to a handle for a user to hold to by a connecting member in a manner that the inner roller can be forced by the handle controlled by the user to coaxially rotate inside the through hole and press against the inner surface of the hollow cylindrical roller to urge the hollow cylindrical roller to roll over a skin surface of the user. While the hollow cylindrical roller is in contact with the skin surface of the user in a manner that one end of the opening is sealed by the skin surface and another end of the opening is simultaneously sealed by the inner roller, the sealed opening would impose a sucking effect to the skin surface to suck out stains inside skin pores and horny layers on the skin.

4 Claims, 5 Drawing Sheets

FACIAL MASSAGER

FIELD OF THE INVENTION

This invention relates to facial massagers, and more particularly, to a facial massager for massaging the skin of a user.

DESCRIPTION OF THE PRIOR ART

It is a nature of women to beautify themselves and make themselves look younger, so the cosmetic is used to achieve such purposes. However, to remove make-up applied on the face, cleaning agents, such as lotion, are usually used to clean up the facial skin in order to prevent stains or residue of the make-up from remaining inside the skin pores. One drawback to the use of conventional cleaning agents is that the removal of stains or residue of make-up from the facial skin simply by conventional cleaning agents is not always complete.

In order to keep the facial skin to be bouncy a facial massager is typically used to roll over the facial skin to perform facial massage by a roller having a plurality of cams or strips formed on a peripheral surface of the roller for improving blood circulation of the facial skin. However, the conventional facial massager can only roll over the facial skin to massage and stimulate the skin without the function of removing the stains or make-up residue embedded in the skin pores form the facial skin. Therefore, it is desirable to have a facial massager which performs both massaging function and skin cleaning function.

SUMMARY OF THE INVENTION

It is therefore a primary objective of the present invention to provide a facial massager which can both massage and clean skin in the same time.

In accordance with the foregoing and other objectives of the present invention, there is provided with a novel facial massager for performing skin massage for improving blood circulation of the skin and skin cleaning for removing stains in skin pores or horny layer from the skin. The facial massager of the present invention includes a hollow cylindrical roller having an outer surface, an inner surface opposing the outer surface and defining a through hole extending along the axial direction of the hollow cylindrical roller, and a plurality of openings extending from the outer surface to the inner surface of the hollow cylindrical roller; an inner roller coaxially sleeved in the through hole and having a diameter smaller than the through hole so as to allow the inner roller to axially rotate in the through hole; and a handle coupled to the inner roller by a connecting means in a manner that the inner roller can be forced by the handle to axially rotate inside the through hole and in the same time to press against the inner surface of the hollow cylindrical roller to urge the hollow cylindrical roller to roll over a skin surface of a user.

BRIEF DESCRIPTION OF DRAWINGS

The present invention can be more fully understood by reading the subsequent detailed description of the preferred embodiment thereof with references made to the accompanying drawings, wherein.

DETAILED DESCRIPTION OF PREFERRED EMBODIMENT

Figure 1:
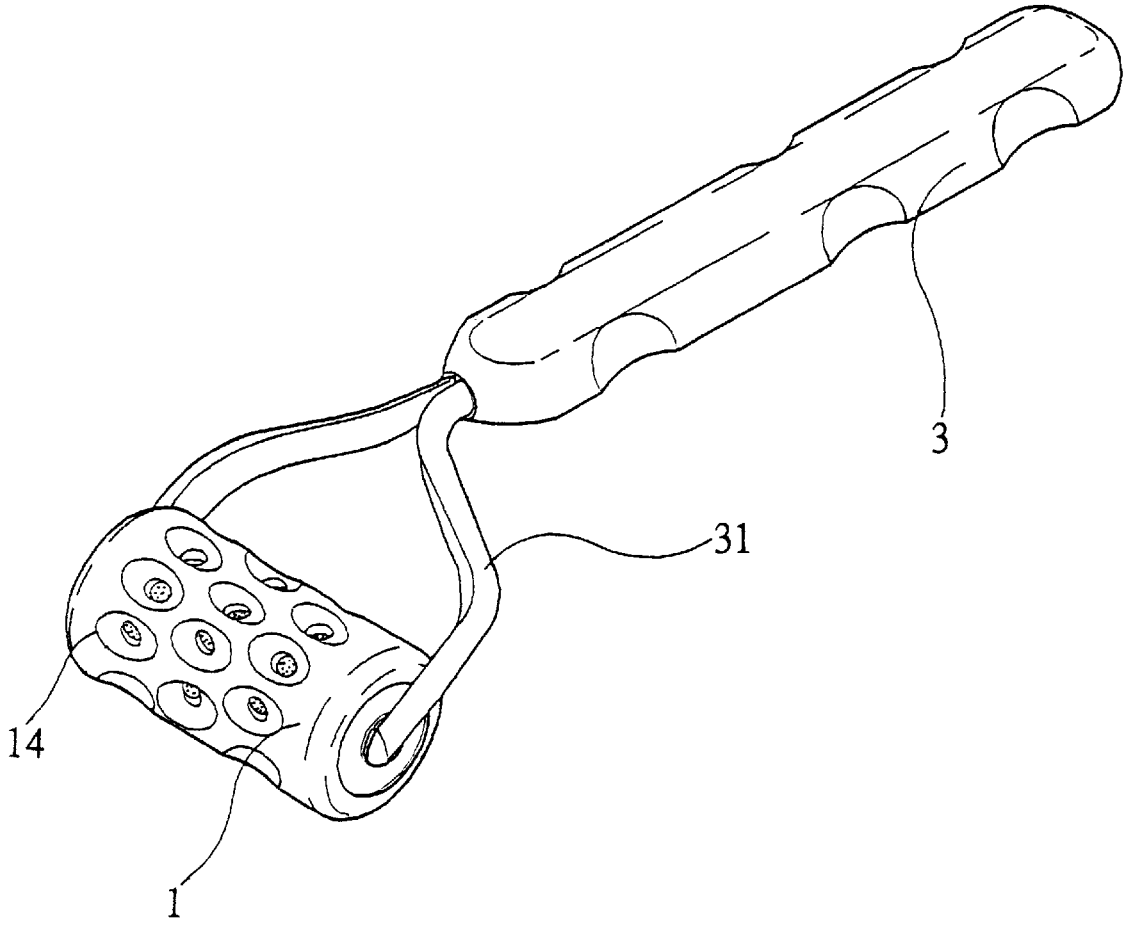
FIG. 1 is a perspective view showing the facial massager in accordance with the present invention.
Figure 2:
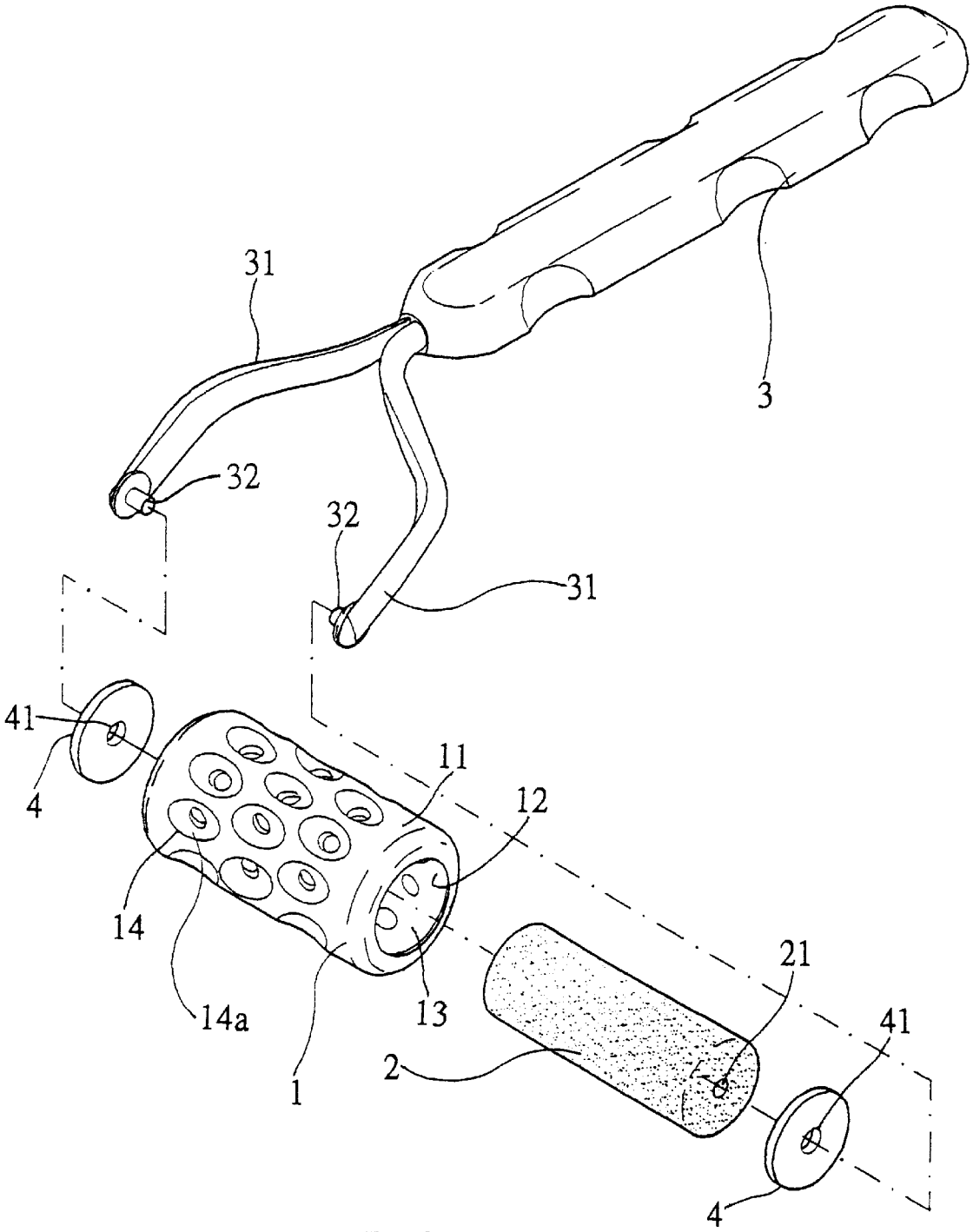
FIG. 2 is a explosive view illustrating constituent parts of the facial massager in accordance with the present invention.

FIG. 1 is a schematic perspective view and FIG. 2 is an explosive view showing the facial massager in accordance with a preferred embodiment of the present invention. As shown in the drawings, the facial massager of this invention includes a hollow cylindrical roller 1, an inner roller 2 which is rotatably received within the hollow cylindrical roller 1, and a handle 3 adapted to be coupled to the inner roller 2.

Referring now to FIG. 2, the hollow cylindrical roller 1 has an outer surface 11 and an inner surface 12 opposing the outer surface 11. A through hole 13 defined by the inner surface 12 is formed along the axially extending direction of the hollow cylindrical roller 1 to coaxially receive the inner roller 2. As the through hole 13 is set to be diametrically greater than the inner roller 2, the inner roller 2 is allowed to freely rotate within the hollow cylindrical roller 1. The hollow cylindrical roller 1 is also formed with a plurality of openings 14 extending from the outer surface 11 to the inner surface 12, allowing the openings 14 to connect with the through hole 13. Each of the openings 14 has a diametrically enlarged portion 14*a* connected to the outer surface 11 of the hollow cylindrical roller 1. In order to enhance the massaging effect at the time the facial massager of the present invention is applied to user's skin, the outer surface 11 of the hollow cylindrical roller 1 can be made into a wavelike form or formed with a plurality of protrusions (not shown).

Figure 3:
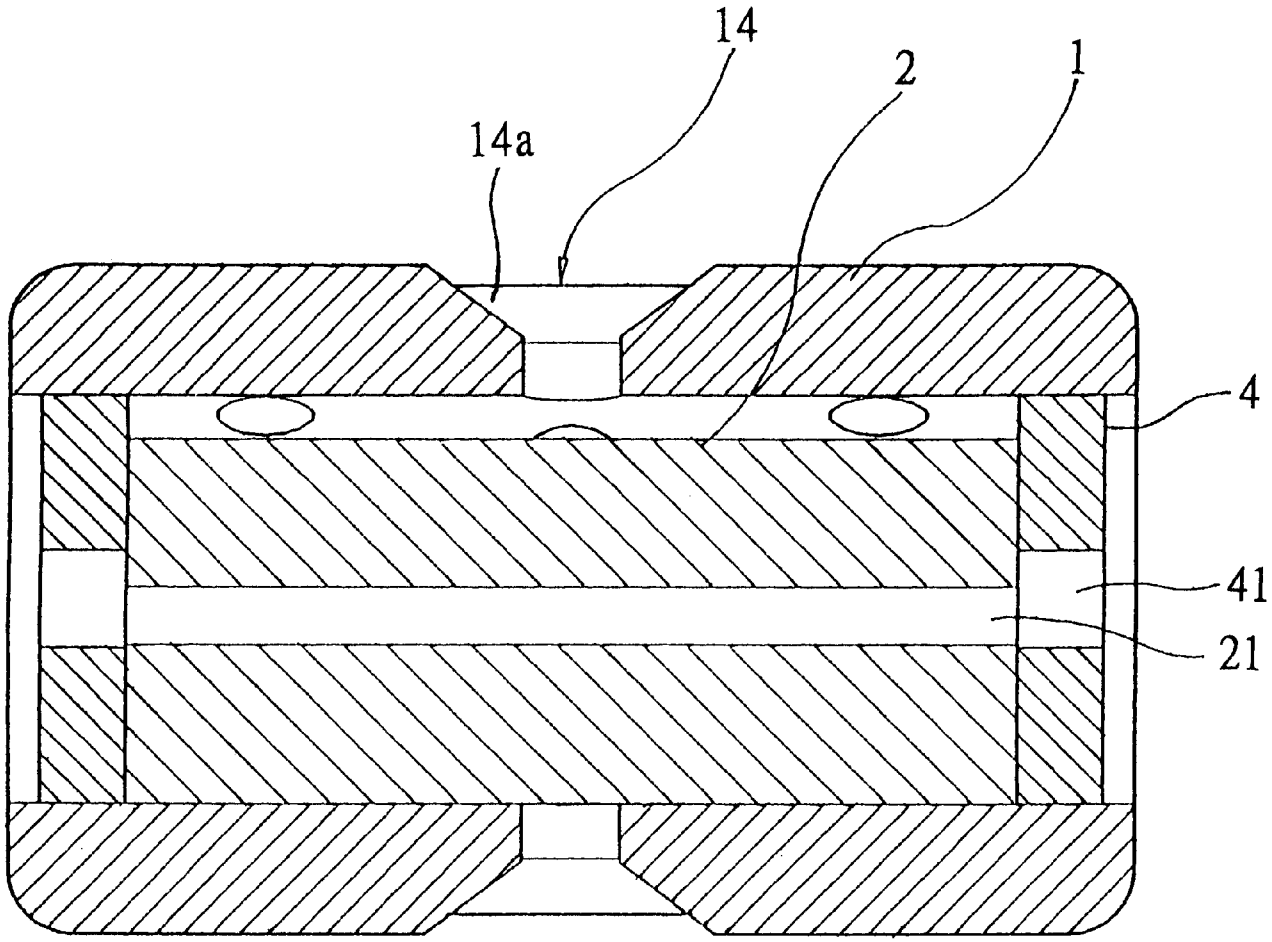
FIG. 3 is a longitudinal-sectional view taken through the longitudinal section of the facial massager in accordance with the present invention.

As also shown in FIGS. 2 and 3, the inner roller 2 has an insertion hole 21 formed along the axis of the inner roller 2 for a pair of projecting axes 32 each projected from an inner side of one of a pair of connecting members 31 connected to one end of the handle 3, to rotatably insert thereinto. In this arrangement, the inner roller 2 is allowed to rotate about the projecting axis 32 of the handle 3 within the through hole 13 of the hollow cylindrical roller 1 by the movement of the handle 3. Further, there can be provided a covering member 4 on each end of the hollow cylindrical roller 1 for covering the open end of the through hole 13. The covering member 4 is also formed with a hole 41 in the center for the projecting axis 32 of the handle 3 to penetrate therethrough.

Figure 4:
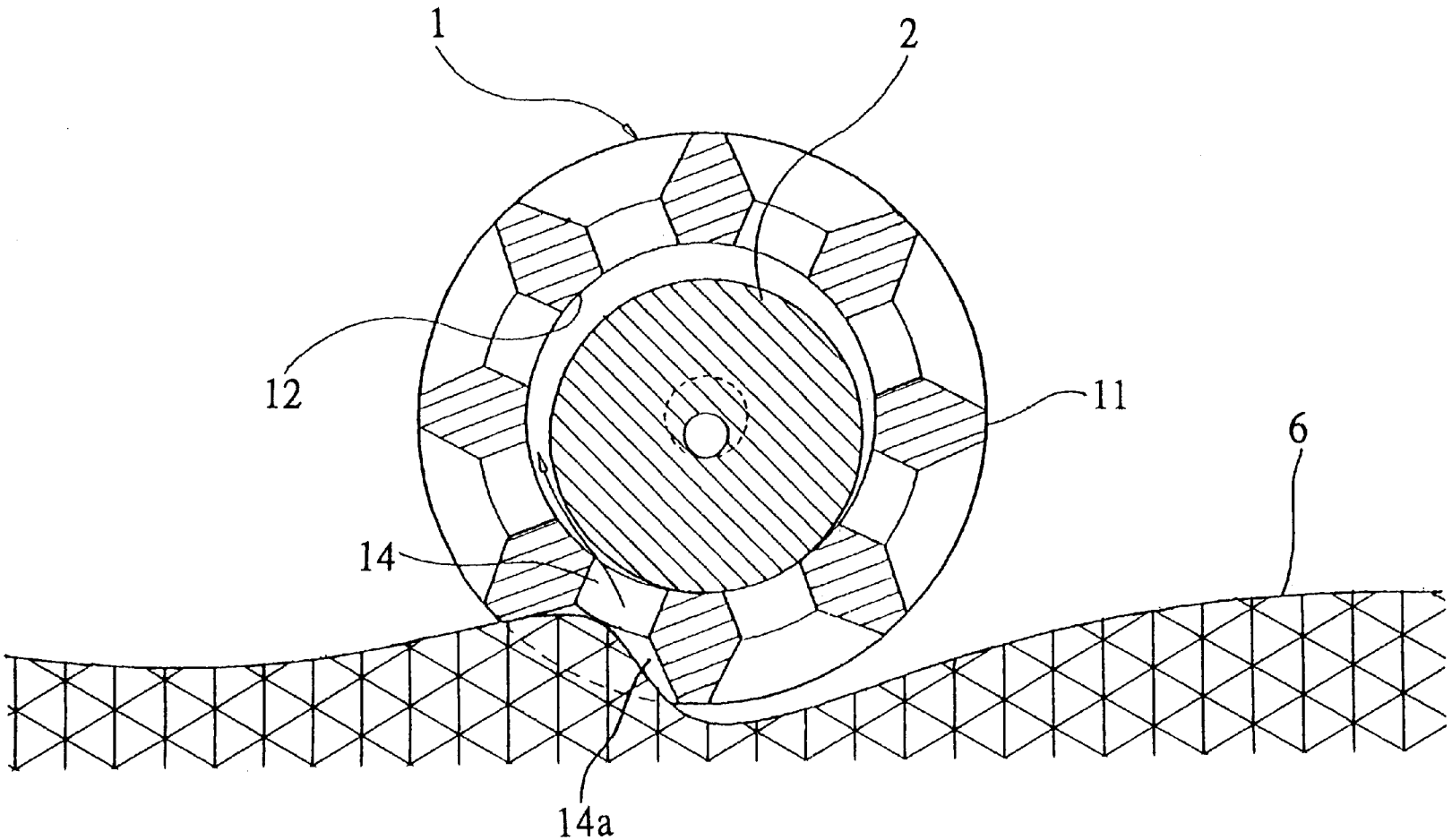
FIG. 4 is a cross-sectional view taken through the cross section of the facial massager in accordance with the present invention when applied to the skin of a user.
Figure 5:
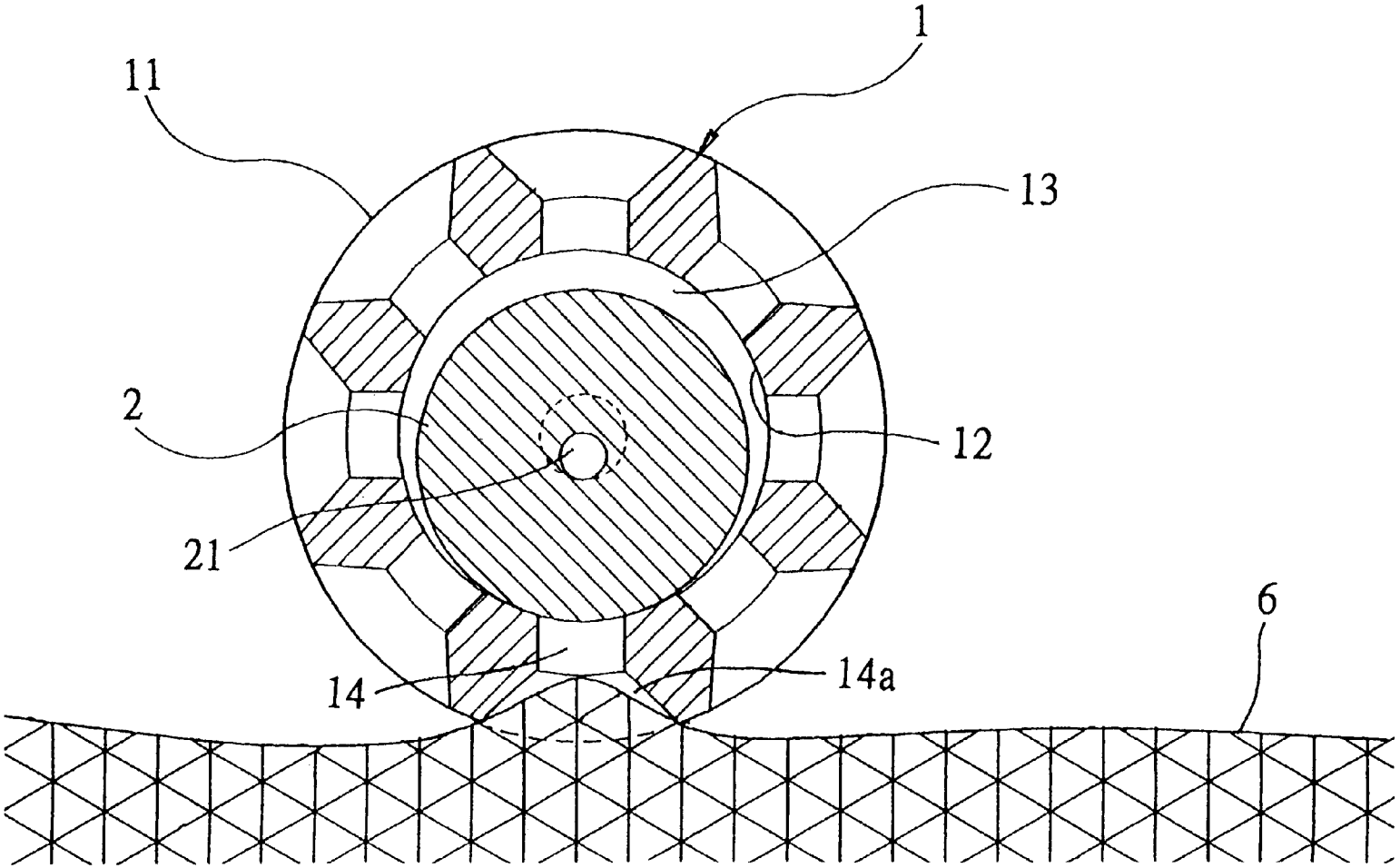
FIG. 5 is a schematic view illustrating the application of the facial massager in accordance with the present invention to a skin surface of a user while the opening is sealed in both ends.

As shown in FIG. 4, because the handle 3 adapted for a user to hold to is essentially perpendicular to the direction of extension of the inner roller 2, the inner roller 2 is accordingly caused to rotate about the projecting axes 32 within the through hole 13 after the hollow cylindrical roller 1 of the facial massager of the present invention is disposed to contact the skin surface 6 of the user and clockwisely rolled over the skin to the left side of the drawing by moving the handle 3. When the hollow cylindrical roller 1 is rolled over and urged against the skin 6, the skin 6 is upwardly pressed to partially enter the opening 14 so that the air in the opening 14 is expelled to the through hole 13 due to the nature of human skin which is flexible and bouncy, as indicated by the arrow in FIG. 4. Continuing the clockwise rolling of the hollow cylindrical roller 1, as shown in FIG. 5, the opening 14 is air-tightly sealed by the skin 6 and the inner roller 2 to its both ends. At this time, there is formed a negative pressure condition in the opening 14 so that the negative pressure condition in the opening 14 results in a sucking effect on the surface of the skin 6, allowing the skin 6 to be sucked toward the inside of the opening 14. As the sucking effect when incurred is imposed on the skin 6, it helps the removal of stains in the skin pores and the horny layer deposited on the skin. Therefore, the facial massager provides not only a massaging effect incurred when the hollow cylindrical roller 1 is rolled over the skin 6 but also a cleaning effect on the skin 6 resulting from the formation of the air-tight condition in the opening 14.

The present invention has been described hitherto with exemplary preferred embodiments. However, it is to be understood that the scope of the present invention need not be limited to the disclosed preferred embodiments. On the contrary, it is intended to cover various modifications and similar arrangements with the scope defined in the following appended claims. The scope of the claims should be accorded the broadest interpretation so as to encompass all such modifications and similar arrangements.

What is claimed is:

1. A facial massager, comprising:

a hollow cylindrical roller having an outer surface, an inner surface opposing the outer surface and defining a through hole extending along a length of the hollow cylindrical roller, and a plurality of openings extending from the outer surface to the inner surface to connect with the through hole;

an inner roller coaxially sleeved in the through hole and being diametrically smaller than the through hole so as to allow the inner roller to axially rotate in the through hole; and a handle coupled to the inner roller by a connecting means.

2. The facial massager of claim 1, wherein each of the openings has an diametrically enlarged portion connected to the outer surface of the hollow cylindrical roller.

3. The facial massager of claim 1, wherein the inner roller is adapted to seal an end of the opening which is connected to the inner surface of the hollow cylindrical roller.

4. The facial massager of claim 1, wherein the connecting means is a pair of connecting members each having a projecting axis projected from its inner side for being inserted into an insertion hole formed in the inner roller so as to couple the handle to the inner roller.

* * * * *